US005342245A

United States Patent [19]

Webb, Jr.

[11] Patent Number: 5,342,245

[45] Date of Patent: Aug. 30, 1994

[54] BOUNCING SWING

[76] Inventor: Ted J. Webb, Jr., 909 Adeline St., Hattiesburg, Miss. 39401

[21] Appl. No.: 919,228

[22] Filed: Jul. 27, 1992

[51] Int. Cl.[5] ..... A63G 9/00

[52] U.S. Cl. ..... 472/118; 472/135

[58] Field of Search ..... 472/118, 120, 121, 122, 472/14, 135; 434/29; 273/413, 85 R

[56] References Cited

U.S. PATENT DOCUMENTS

| | | | |
|---|---|---|---|
| 2,532,444 | 12/1950 | Germana | 472/118 |
| 2,709,079 | 5/1955 | Bubb et al. | 472/135 |
| 3,186,711 | 6/1965 | Morrow | 273/413 |
| 3,411,774 | 11/1968 | Thornton | 472/118 |
| 4,296,923 | 10/1981 | Ahrens | 472/118 |
| 4,431,183 | 2/1984 | Reimann | 472/118 |

*Primary Examiner*—Carl D. Friedman
*Assistant Examiner*—Kien Nguyen
*Attorney, Agent, or Firm*—Shlesinger, Arkwright & Garvey

[57] ABSTRACT

A recreational swing used as a children's toy which incorporates a pronounced bouncing action along with the pendulum motion of a traditional swing. The bouncing swing utilizes an extension device enclosed in and attached to a rigid tube which is fastened to the swing seat. The weight of the child extends the device which gently rebounds as the child swings. The tubular sleeve protects the child from the action of the extension device and also acts as a handle. The swing is suspended by a rope, chain, or cable from an overhead support.

20 Claims, 2 Drawing Sheets

BOUNCING SWING

BACKGROUND OF THE INVENTION

Adults and children are interested in outdoor recreational toys which can provide a unique playtime experience. The most important issue for a parent or guardian in evaluating children's recreational devices should be the safety of the toy and the skill level necessary for a child to enjoy the plaything.

As a secondary requirement, the function and use of a new outside toy must be easy to comprehend by children without excessive instruction or supervision. It should be weather resistant and should remain relatively cool to the touch even after prolonged exposure to direct sunlight.

BRIEF STATEMENT OF THE INVENTION

I have invented and developed a recreational swing which incorporates a pronounced, but gentle, bouncing action with the pendulum motion of a traditional rope swing. The design meets the objectives of a safe toy as stated above.

The prototype utilizes a heavy gauge extension spring which is enclosed in and attached to a rigid tube. Other extension devices such as a rubber or elastic bungee could be substituted for the spring. A swing seat is joined to the tube and is locked in place between a collar and reinforced base. The sleeve or tube shields the rider from the accordion action of the extension spring and also serves as a secure handle. The handle is of sufficient length to deter contact between the rider and the rope or cable during the vertical movement of the swing. There is a cap attached at the top of the tube which further prohibits a child from placing his fingers or objects into the tube. The top cap also acts as a safety device by preventing overextension of the spring. A second cap is attached at the bottom of the handle, under the swing seat, to prevent a child from placing fingers or objects into the handle from below.

The bouncing swing is suspended by a flexible link such as a rope, cord, cable, or chain from a suitable overhead support, for example, a swing set frame or overhanging tree limb.

The weight of the rider on the swing extends the spring, which gently rebounds, causing a wavelike motion. A child's movement on the swing can perpetuate the bouncing action. Furthermore, the pendulum motion itself causes an extension of the device or spring under the weight of the rider.

BRIEF DESCRIPTION OF THE DRAWING

The invention may be more clearly understood from the following detailed description and by reference to the drawings in which.

Figure 1:
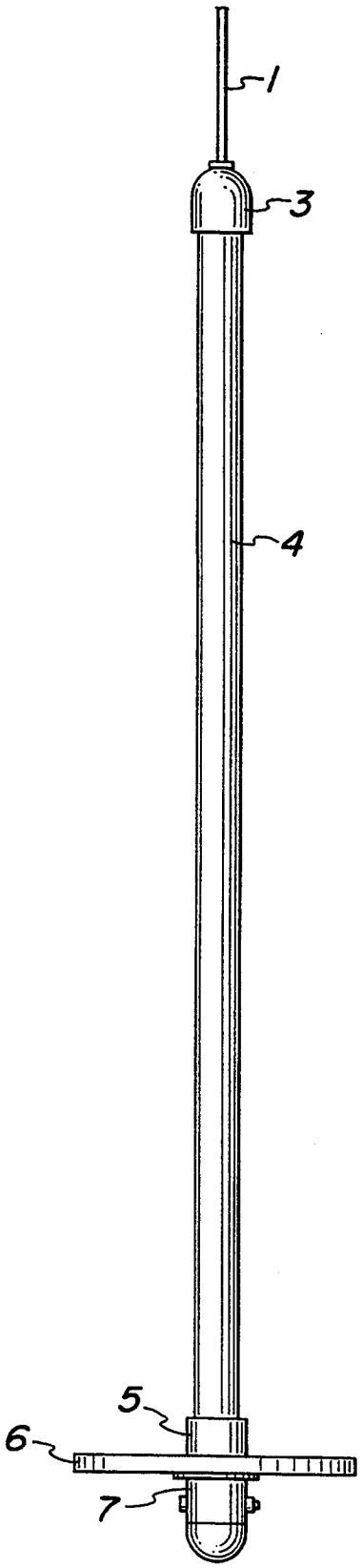
FIG. 1 is a front elevation view of the invention.

A summary of the parts shown in the drawings include:

1. flexible link
2. smooth metal grommet
3. top safety cap
4. swing handle
5. seat collar
6. swing seat
7. reinforced seat base
8. steel anchor bolt
9. steel lock nut
10. metal washer
11. bottom safety cap
12. extension spring
**12*a***. spring looped end

DETAILED DESCRIPTION OF THE INVENTION

Now referring to FIG. 1, a recreational bouncing swing would be attached to a stationary overhead support, for example, a swing set frame or tree limb. The bouncing swing includes a handle 4 which is a rigid, hollow tube, such as Schedule 40 PVC (polyvinyl chloride) tubing.

A round or oblong, wooden seat 6 has a center hole which slips over the handle 4. The swing seat 6 is supported by a reinforced base 7 which is a larger, tightly fitting coupling tube. A metal washer 10 (FIG. 3), located between the swing seat and the base, distributes the weight of the rider over a wider surface of the seat. The base 7 is bonded to the rigid plastic tube 4 for additional strength. The swing seat 6 is restrained from vertical movement by a collar 5 which is another tightly fitting coupling tube. The collar 5 is fastened to the handle 4 by screws.

Figure 2:
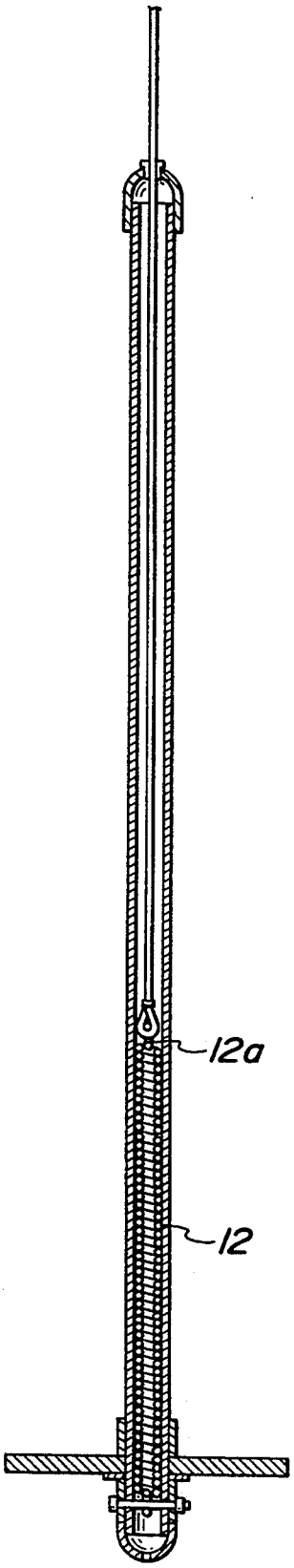
FIG. 2 is an elevation cross-section view of the invention.

The bouncing swing is suspended by a flexible link 1, such as a rope, chain, or cable, from a stationary overhead support. The singular link allows for a 360 degree rotation of the swing around the axis or link 1. The rope 1 extends down through the top safety cap 3 into the handle 4 and is attached to a hooking looped end **12*a* of an extension spring 12, as shown in FIG. 2, by means of a knot or clamp. The extension device 12 is fastened to the swing through the handle 4 and reinforced base 7 by use of a steel anchor 8, see FIG. 3. The galvanized steel bolt 8 is assembled with a galvanized steel hex nut 9**.

Figure 3:
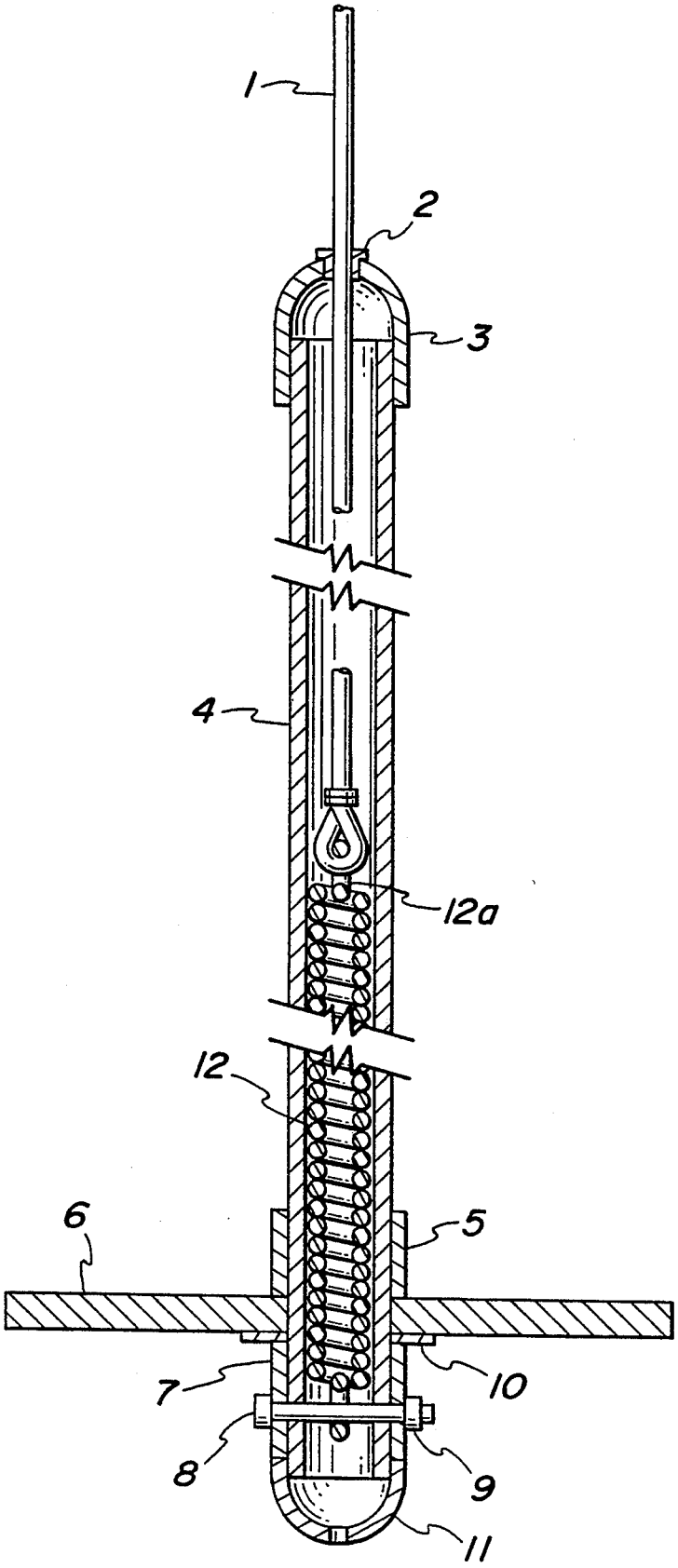
FIG. 3 is an elevation cross-section view of the invention with the spring in extension.

The weight and movement of the rider extends the spring or bungee 12 as shown in FIG. 3. The tension in the spring causes a gentle rebound which produces a wavelike bouncing motion. As the spring 12 extends and rebounds, the entire swing moves up and down along the rope or cable 1. The top safety cap 3 is a rigid covering which fits the tube handle and is attached by screws. The cap 3 has a center hole large enough to allow for passage of the flexible link and is protected from friction, caused by the movement of the swing along the rope or cable 1, by a smooth metal grommet 2. The grommet 2 has a diameter of approximately 0.5 inches, which prevents a child from placing fingers or other objects into the tube. The top safety cap 3 also prohibits over-extension of the spring or bungee 12 and acts to restrain the swing from contact with the ground. The handle has a bottom safety cap 11, a rigid covering which fits over the tube handle and is bonded or attached with screws. The bottom cap 11 has a small center hold to allow for drainage.

The handle 4 is also of sufficient length to protect the rider from contact with the flexible link 1 during the vertical motion of the swing caused by the extension and rebound action of the spring 12.

The preferred embodiment of this invention is as follows:

| | |
|---|---|
| Swing | 60 inches, rigid plastic tubing, |

-continued

| | |
|---|---|
| Handle | 2.375 inch outside diameter, 0.155 inch wall thickness. |
| Swing Seat | 13 inch diameter, wooden round, 0.75 inch thickness, 2.40 inch center hole. |
| Seat Collar | 1.18 inch length, rigid plastic coupling tube, 2.72 inch outside diameter, 0.31 inch wall thickness. |
| Seat Base | 1.50 inch length, rigid plastic coupling tube, 2.72 inch outside diameter, 0.31 inch wall thickness. |
| Extension Device | 27.5 inch heavy gauge steel extension spring, 1.75 inch diameter, 150 pound weight limit; however, the weight limits of the extension device can be matched to the weight range(s) of the rider(s). |

This invention shall not be limited to the illustrative embodiment but rather to the claims as set forth below which constitute definitions of this invention including the protection afforded by the doctrine of equivalents.

What is claimed is:

1. A swing, comprising:

a) a seat;

b) a tube connected to said seat for movement therewith;

c) an extension spring having an upper end and a lower end;

d) said lower end of said extension spring being connected to a portion of said tube substantially adjacent to said seat for resiliently supporting said seat; and e) an elongated member connected to said upper end of said spring.

2. A swing as defined in claim 1, wherein:

a) said lower end of said extension spring is substantially stationary relative to said seat.

3. A swing as defined in claim 1, wherein:

a) said elongated member includes rope.

4. A swing as defined in claim 1, wherein:

a) said elongated member includes a chain.

5. A swing as defined in claim 1, wherein:

a) said extension spring is disposed substantially within said tube.

6. A swing as defined in claim 5, wherein:

a) said tube includes an upper end and a lower end;

b) a safety cap having an opening therein is disposed on said upper end of said tube; and c) said elongated member extends through said opening in said safety cap.

7. A swing as defined in claim 6, wherein:

a) said safety cap is configured for preventing the introduction of foreign objects into said tube.

8. A swing as defined in claim 6, wherein:

a) said safety cap is configured for preventing the overextension of said extension spring.

9. A swing as defined in claim 6, wherein:

a) a smooth metal grommet is disposed in said opening in said safety cap.

10. A swing as defined in claim 1, wherein:

a) said seat is sufficiently large to accommodate a human rider when sitting and when standing.

11. A swing as defined in claim 10, wherein:

a) said tube extends transversely relative to said seat; and b) said tube is sufficiently long so that a human rider can hold said tube with the hands of the human rider when standing on said seat during use.

12. A swing, comprising:

a) a seat;

b) a tube connected to said seat for movement therewith;

c) a spring having an upper end and a lower end;

d) said lower end of said spring being substantially directly connected to a portion of said tube for resiliently supporting said seat; and e) an elongated member connected to said upper end of said spring.

13. A swing as defined in claim 12, wherein:

a) said spring is disposed within said tube.

14. A swing as defined in claim 12, wherein:

a) said spring includes an extension spring.

15. A swing as defined in claim 12, wherein:

a) said elongated member includes a rope.

16. A swing as defined in claim 12, wherein:

a) said elongated member comprises a cable.

17. A swing as defined in claim 12, wherein:

a) said seat is sufficiently large to accommodate a human rider when sitting and when standing.

18. A swing as defined in claim 12, wherein:

a) said tube extends transversely relative to said seat; and b) said tube is sufficiently long so that a human rider can hold said tube with the hands of the human rider when standing on said seat during use.

19. A swing, comprising:

a) a seat;

b) a tube having an upper end and lower end;

c) said lower end of said tube being fastened to said seat;

d) a spring device having an upper end and a lower end;

e) said lower end of said spring device being attached to said lower end of said tube; and f) an elongated member attached to said upper end of said spring device.

20. A swing as defined in claim 19, wherein:

a) said spring device is disposed substantially within said tube.

* * * * *